US005366510A

United States Patent [19]

Wasinger et al.

[11] Patent Number: 5,366,510

[45] Date of Patent: Nov. 22, 1994

[54] PROCESS FOR DESIZING AND COLOR FADING GARMENTS

[75] Inventors: Eric Wasinger, P.O. Box 886, Adamsville, Tenn. 38310; David Hall, Auburn, Ala.

[73] Assignee: Eric Wasinger, Adamsville, Tenn.

[21] Appl. No.: 895,920

[22] Filed: Jun. 9, 1992

[51] Int. Cl.[5] ..... D06L 3/02; B01D 19/00

[52] U.S. Cl. ..... 8/110; 8/111; 252/188.1; 252/188.21; 252/188.22

[58] Field of Search ..... 208/110, 111; 252/188.1, 188.21, 188.22

[56] References Cited

U.S. PATENT DOCUMENTS

| | | | |
|---|---|---|---|
| 4,231,890 | 11/1980 | Yagi et al. | 252/186 |
| 5,118,322 | 6/1992 | Wasinger et al. | 8/111 |
| 5,171,332 | 12/1992 | Spencer, III | 8/111 |
| 5,199,957 | 4/1993 | Pascoe | 8/478 |

OTHER PUBLICATIONS

Hawley's Condensed Chemical Dictionary 11th Ed 1990 Van Nostrand Reinhold Publ., p. 947, "Polyvinylpyrrolidone".

*Primary Examiner*—Johann Richter
*Attorney, Agent, or Firm*—John Lezdey

[57] ABSTRACT

A process for desizing an/or color fading of fabrics and garments utilizing a reducing agent. The process is particularly for pretreating fabrics which are subsequently decolorized with oxidizing agents.

13 Claims, No Drawings

PROCESS FOR DESIZING AND COLOR FADING GARMENTS

FIELD OF THE INVENTION

The present invention relates to a process for desizing and/or the color fading of fabrics and garments. More particularly, there is provided a process for the simultaneous desizing and decolorizing of dyed fabrics and garments utilizing a reducing agent.

BACKGROUND OF THE INVENTION

Garment and fabric processing today includes dyeing and desizing. Sizing is important in the fabric weaving process. The size is usually removed in a finishing operation after the fabric is woven. In some fabrics e.g. denim, the size is left in to give desirable properties to the denim garment so as to improve the wear properties of the fabrics or garments. However, if the garments or fabrics are further processed, for example, treated with a crosslinking agent and/or decolorized or finished in garment form, it is necessary to first remove the sizing.

The removal of sizing is today performed in most textile plants by one or more of the following methods. The primary method of desizing is enzymatically, for example utilizing amylolytic enzymes. In garment finishing this process is more costly. Mechanical action is another method of desizing. In this method, abrasive drum linings in extractors and/or pumice stones are utilized to improve the garment softness, give the garment special features, etc. Alkaline and acidic hydrolysis have also been employed but such techniques also cause chemical attack of the fabric so as to result in a loss of the abrasive strength of the fabric. Oxidative desizing is generally employed using large amounts of sodium hypochlorite in solution. The use of hypochlorite creates environmental problem and further can significantly degrade the fabric. Desizing is required where the fabrics or garments are to undergo further processing such as dyeing, printing, decolorization, treatment with a crosslinker, ozone treatments and the like.

Garment dyeing technology, particularly with denim jeans, to achieve a differential color appearance has focused on treatments in which the dyer starts with a dyed garment and achieves a differential color effect by partial color removal. Removal of color is achieved by use of porous stones soaked in oxidizing agents, such as strong bleach or permanganates, and more recently, by treatment with cellulase enzymes to remove fiber and thereby also remove some sizing.

The desizing and removal of color of denim garments generally requires two independent operations wherein the sizing is first removed and then the garment is treated chemically or physically to obtain removal of the color. It would be more economical and less time consuming if the two operations could be accomplished simultaneously. Such a procedure would be advantageous in garment treating processes wherein the garment undergoes a color fading procedure such as treatment with a bleaching agent or an oxidizing agent such as ozone, permanganates, sodium hypochlorite and the like.

SUMMARY OF THE INVENTION

The present invention provides a process for the simultaneous desizing and/or decolorizing of fabrics and garments utilizing a reducing agent. More particularly, the invention provides a means for removing sizing and/or dyes from garments and fabrics which are to be subsequently oxidized or bleached.

Advantageously, the fabrics or garments are treated with a reducing agent while in an aqueous bath at elevated temperatures. Temperatures of the bath between about 120° to 180° F. are suitable for the simultaneous desizing and dye removal of fabrics.

Accordingly, the fabric with a portion of the dye removed requires less time and bleaching agent or oxidizing agent in order to produce a garment having the appearance of being "stone washed" or "acid washed".

It is therefore a general object of the invention to provide a means for simultaneously desizing and decolorizing a fabric or garment.

It is another object of the invention to desize a garment more efficiently and in a shorter time than with enzymes.

It is yet another object of the invention to prepare a fabric or garment for further treatment by removal of a sizing agent.

It is yet still further object of the invention to selectively and/or evenly decolorize or fade dyed garments to produce fashion garments.

It is another object of the invention to provide garments with different degrees of color by use of dyes of varying sensitivity to reducing agents and/or to provide different levels of colorization throughout the garment.

DESCRIPTION OF THE PREFERRED EMBODIMENTS

Although specific terms are used in the following description for the sake of clarity, these terms are intended to refer only to the particular feature of the invention selected for illustration and are not intended to define or limit the scope of the invention.

According to the present invention, sized and/or dyed fabrics and garments which are required to be desized before undergoing further processing can be treated with a reducing agent so as to remove the sizing. If desired, such as in the case of denim jeans, where the present fashion requirement is a bleached or washed appearance, the garment can be simultaneously decolorized. Typically, blue jeans which would normally undergo only desizing in a washer-extractor, can now undergo simultaneous desizing and decolorization by treatment with a reducing agent.

The denim jeans are normally placed in a drum type washer-extractor and covered with water at an elevated temperature, preferably at a temperature range between about 120° to 180° F. A reducing agent is added and the mixture is agitated for a period of about 20 minutes, depending upon the reducing agent and type of sizing utilized.

Advantageously, a dye complexing agent such as polyvinyl pyrrolidone is added to prevent redeposit of the degradated dye.

Typical reducing agents which are useful for desizing starch type sizing and decolorizing denim jeans include alkali metal hydrosulfites, for example, sodium hydrosulfite, alkali metal sulfoxylate formaldehyde, for example $NaHSO_2—CH_2—2H_2O$, thiourea dioxide, and the like.

Reducing agents which are primarily useful for decolorization of the fabrics include the alkali metal hydrogen sulfites, sulfides, thiosulfates, oxalates, hydrosulfites and sulfides.

The compounds which are especially useful for reducing sulfur dyes include sodium hydrosulfite, sodium hydrosulfide and sodium sulfide.

Other suitable reducing agents include arsenious oxide and titaneous sulfate, which is useful for reducing reactive dyes.

Advantageously, sodium or zinc sulfoxylate formaldehyde is used under either acidic or basic conditions and sodium hydrosulfite is used under basic conditions.

The garments or fabrics to which the present may be applied comprise both natural and/or synthetic fibers including cotton, linen, other bast fibers, rayon, wool, polyester, rayon, alone or in combination with other natural or synthetic fibers.

Preferably, the garment or fabric is desized and/or decolorized without causing degradation of the fabric.

The type of dye used on the garment is not critical. It is only important that the dye is reactive with the reducing agent where intended. Cellulose substantive dyes, such as vat dyes, which are common in the garment industry, are preferably used. Exemplary of the dyes which are or can be made to be substantive to cellulose that can be used include Acid Light Scarlet GL, and acid leveling dye, Sevron Brilliant Red 2B, indigo vat dye, a cationic dye, Sulfonine Brilliant Red B, and anionic dye, Brilliant Milling Red B, C. I. Disperse Blue, pyrazolone azomethine dye, hydroxy azo dyes, or the like. Other suitable dyes that can be used are identified in the paper of Charles B. Sweeney entitled, "Identifying a Dye can be Simple or it can Involve Hours of Laboratory Analysis", Textile Chemist and Colorist, Vol. 2, No. 1, January 1980, pp 26/11, which is incorporated herein by reference.

The garments may be colored (dyed) with one or more dyes. Utilizing dyes of differing degrees of reactivities provides the garment with zones of different appearances or effects. For example, faded, stone washed, ice-washed, sand blasted or mottled effects may be obtained. The same effect can be achieved by utilizing blocking agents. The blocking agents may comprise organic materials such as hydrocarbon oils, greases or waxes or inorganic materials such as clay which are not reduced. Masking tape, or other coverings may be used.

The blocking agent can also be any chemical agent which itself is reduced with the reducing agent but prevents or blocks a dye or portion of a dye on the fabric from becoming decolorized.

In a preferred operation of the process of the invention the garments or fabrics are placed in a washer-extractor which is similar to the type that would have been utilized in a conventional desizing operation utilizing an enzyme. The washer-extractor is then filled with water having an elevated temperature, that is, about 120° to 185° F. The higher the temperature the greater the discoloration. It is understood that at the higher temperatures the reducing agent selected must have a requiste temperature stability. The pH of the bath is adjusted according to the type of reducing agent utilized. The reducing agent is then added to the bath. The bath is normally agitated for about 0.3 to 1.0 hour and then the water is extracted and the garments or fabrics are rinsed with water. The garments or fabrics can then be further processed if desired.

The amount of reducing agent utilized is determined by the type of reducing agent utilized and the effect desired. For example, in a commercial size washer-extractor in which about 180 denim jeans are to be desized, when thiourea dioxide is the reducing agent, about 0.75 lbs is used in a bath containing 260 gal. of water to achieve a light blue effect. While 1.5 lbs gives a pale blue effect. With sodium hydrosulfite as the reducing agent, about 1.75 lbs is utilized to achieve a similar result. It is understood that compounds such as polyvinylpyrrolidone can be added to the system to prevent redeposition of the dye removed from the garments during reduction.

The invention is particularly useful in preparing fashion garments such as faded denim blue jeans, and the like, without the use of harsh chemical bleaches or the abrasive effects of stones, pumice, sand or the like.

The reducing agents are particularly effective where the sizing comprises a starch, starch derivative or a modified starch.

Denim blue jeans and jackets which have been faded, "stone-washed", ice washed, and/or sand blasted to produce a particular appearance are very popular. However, to produce the desired effect it has been necessary to utilize processes which cause substantial deterioration or degradation of the fabric. Bleaching solutions containing chlorine or actual pelleting of the garment with sand or stones to produce a fashion effect causes damage to the fabric which affects its wear life.

Special effects can also be achieved by selectively treating the garment with dyes having different degrees of reactivity. The non-reactive or lesser reactive dyes may be applied by spraying, brushing, dipping, or the like. In a similar manner reducing agents can then be applied.

The application of reducing agents to garments by stones soaked in these reagents also provides a means of modifying the color of the garments and of modifying the texture of the garment. The stones, such as pumice stones, that are ordinarily used in stone washing, can be soaked in a suitable reducing solution and then tumbled with the garment. The areas which are touched by the stones would undergo greater decolorization so that a color differential would occur on the garment. The pattern and the decolorization differential may be varied by utilizing stones which have been treated with different types of reducing agents.

The following examples are illustrative of the practice of the method of the present invention. It will be understood, however, that is not to be construed in any way limitative of the full scope of the invention since various changes can be made without departing from the spirit of the teachings contained herein in light of the guiding principles which have been set forth above. All percentages stated herein are based on weight except wherein otherwise noted.

EXAMPLE 1

Into a 500 gal. capacity rotary drum washer-extractor was placed 180 blue dyed denim jeans containing a starch sizing. 350 gal. of water at a temperature of 175° F. is added to the washer-extractor. The drum is rotated and 0.75 lbs of thiourea dioxide together with 2.0 lbs of 50% sodium hydroxide is added. The drum was rotated for about 20 minutes and the water was extracted. The garments were then rinsed twice with 220 gal. of cold water and spun to extract the water.

The resulting garments were all desized and decolorized to a very light blue. When 1.5 lbs thiourea and 4 lbs 50% NaOH is added a pale blue color was obtained. If an even lighter color is desired the process can be repeated for 10 minutes prior to rinsing since concurrent desizing is not necessary.

The garments can be further decolorized by subjecting them to a standard bleaching operation or by treatment with ozone.

EXAMPLE 2

The procedure of Example 1 was followed except that in lieu of 0.75 lbs of thiourea dioxide and the sodium hydroxide there was utilized 3.0 lbs of sodium sulfoxylate formaldehyde and sufficient citric acid to give a pH of 4.0–4.5 (buffered with sodium citrate) or acetic acid (56%) buffered with sodium acetate at a temperature of 180°–185° F.

The resulting garments were all desized and decolorized to a pale blue.

EXAMPLE 3

A concentrated solution of sodium hydrosulfite was prepared and approximately two pounds of pumice stones were soaked in the solution for one hour. Two enzyme desized denim jeans which were wetted in a 2% sodium hydroxide bath were inserted into a Unimac sample garment dyeing machine. The stones were removed from the solution and inserted into the machine which was rotated at the speed of forty cycles per minute for 7 minutes.

The garments were then washed in a standard home type washer and dried.

The garments were lightened and had a soft hand. The garments gave the appearance of being acid washed.

EXAMPLE 4

The procedure of Example 1 was followed except that 5 lbs sodium hydrosulfite and 10 lbs of 50% NaOH were employed along with 7 lbs of a 40% solution of polyvinylpyrrolidone. The mixture was heated and rotated to 130° F. for 25 minutes.

The resulting garments were all desized and decolorized to a pale blue.

What is claimed is:

1. A method for simultaneously desizing and decolorizing a dyed fabric or dyed garment having a sizing and a reducible dye which comprises treating said fabric or garment with an effective amount of reducing agent in an aqueous bath whereby the fabric or garment is both desized and decolorized prior to any subsequent oxidation or bleaching.

2. The method of claim 1 in which the bath also contains a dye complexing agent.

3. The method of claim 2 wherein said dye complexing agent is polyvinylpyrrolidone.

4. The method of claim 1 wherein the temperature of the bath is about 120° to 180° F.

5. The method of claim 1 wherein said reducing agent is selected from the group consisting of sodium hydrosulfite, thiourea dioxide and sodium sulfoxylate formaldehyde.

6. The method of claim 5 wherein said reducing agent is sodium hydrosulfite and said fabric or garment is in aqueous bath under basic conditions.

7. The method of claim 5 wherein said reducing agent is sodium sulfoxylate formaldehyde and said fabric or garment is in an aqueous bath under acidic conditions.

8. The method of claim 1 wherein said coloring agent is a dye or pigment.

9. A method for decolorizing a fabric or garment having a reducible dye which comprises tumbling said fabric or garment with an effective amount of absorbent stones containing a reducing agent to cause decolorization prior to any subsequent oxidation or bleaching.

10. The method of claim 9 wherein said reducing agent is selected from the group consisting of sodium hydrosulfite, sodium sulfite, sodium thiosulfate and sodium sulfide.

11. The method of claim 9 wherein said dye is a sulfur dye.

12. A method for decolorizing a fabric or garment which comprises treating said fabric or garment with an effective amount of reducing agent in an aqueous bath at a temperature about 120° to 180° F. to cause desizing prior to any subsequent oxidation or bleaching.

13. The method of claim 12 wherein said sizing comprises a starch, starch derivative or modified starch.

* * * * *